US009199824B2

(12) United States Patent
Roussel et al.

(10) Patent No.: US 9,199,824 B2
(45) Date of Patent: Dec. 1, 2015

(54) ACTIVATION OF AN EMERGENCY LIGHT UNIT

(75) Inventors: Frank Olivier Roussel, Lucerne (CH); Lukas Barmet, Emmenbrucke (CH)

(73) Assignee: Inventio AG, Hergiswil (CH)

( * ) Notice: Subject to any disclaimer, the term of this patent is extended or adjusted under 35 U.S.C. 154(b) by 830 days.

(21) Appl. No.: 13/440,258

(22) Filed: Apr. 5, 2012

(65) Prior Publication Data

US 2012/0256549 A1 Oct. 11, 2012

(30) Foreign Application Priority Data

Apr. 5, 2011 (EP) ..... 11161133

(51) Int. Cl.
*B66B 5/02* (2006.01)

(52) U.S. Cl.
CPC ..... *B66B 5/02* (2013.01)

(58) Field of Classification Search
USPC ..... 27/149–159; 315/149–159
See application file for complete search history.

(56) References Cited

U.S. PATENT DOCUMENTS

2005/0248299 A1* 11/2005 Chemel et al. ..... 315/312
2007/0069657 A1* 3/2007 Tuttle et al. ..... 315/159
2012/0256549 A1* 10/2012 Roussel et al. ..... 315/159

FOREIGN PATENT DOCUMENTS

DE 202009013039 U1 12/2009
JP 7228434 A 8/1995

* cited by examiner

*Primary Examiner* — Brandon S Cole
(74) *Attorney, Agent, or Firm* — Fraser Clemens Martin & Miller LLC; William J. Clemens

(57) ABSTRACT

An emergency light unit (arranged in an elevator cage) of an elevator installation can be activated. A light sensor unit and a lighting unit are arranged in the elevator cage. The emergency light unit is activated by an elevator control unit in dependence on at least one light intensity value detected by the light sensor unit when the elevator cage door is closed and transmitted to the control unit.

11 Claims, 5 Drawing Sheets

ACTIVATION OF AN EMERGENCY LIGHT UNIT

CROSS-REFERENCE TO RELATED APPLICATION

This application claims priority to European Patent Application No. 11161133.1, filed Apr. 5, 2011, which is incorporated herein by reference.

FIELD

The disclosure relates to an emergency light unit for an elevator installation.

BACKGROUND

In the case of power failure or a disturbance it could happen in an elevator installation that the passengers in an elevator cage have to wait in darkness for help. In order that this does not occur an emergency light unit, which can provide to the passengers a minimum amount of light, is installed in the elevator cage. This emergency light unit comprises, for example, batteries, capacitors, etc., and is thus, in case of need, independent of the power supply of the elevator cage. It is activated in that a drop in voltage or current is detected. For this purpose the emergency light unit usually comprises a corresponding switching or control unit which detects voltage or current drop and activates the emergency light unit.

SUMMARY

At least some embodiments comprise activating an emergency light unit by the control unit in dependence on at least one light intensity value which is detected by a light sensor unit, for example a photodetector, a radiation detector, a thermal detector, etc., in an elevator cage of an elevator installation and which is transmitted to a control unit. In that case the emergency light unit is arranged in the elevator cage. The elevator cage comprises a lighting unit, for example illuminating means, a bulb, an LED lamp, a fluorescent tube, etc., for illumination of the elevator cage interior and has on at least one side of the cage an elevator door which can be of single-part or multi-part construction, for example a telescopic door.

Detection of the at least one light intensity value by the light sensor unit can be carried out when the elevator door is closed. However, it is also conceivable that detection of the at least one light intensity value takes place when the elevator door is open.

In some embodiments, the emergency light unit is activated by the control unit when at least one light intensity value of a second light intensity curve, which is generated by the control unit, is smaller than at least one light intensity value of a first light intensity curve generated by the control unit.

For that purpose, at least two first light intensity values are determined, possibly at a spacing in time when the lighting unit is deactivated, and are transmitted to the control unit. The control unit adds to each first light intensity value, for example, a tolerance value and generates a first light intensity curve. The first light intensity curve when the lighting unit is deactivated, i.e., the residual light level in the elevator cage, can in that case be stored by the control unit in a memory unit connected with the control unit.

In addition, at least two light intensity values are determined, ideally at a spacing in time, by the light sensor unit when the lighting unit is activated and are transmitted to the control unit. The control unit generates therefrom a second light intensity curve. A tolerance value can be subtracted by the control unit from each second light intensity value. The second light intensity curve less the tolerance value can represent the current light intensity within the elevator cage.

In that case the detection of the at least two first and second light intensity values can respectively take place within a time interval.

The time interval can be as desired. In addition, the spacing in time of the measurement between the at least two first or second light intensity values can be selected to be as desired. The spacing in time can, for example, lie in the millisecond, second or minute range, etc. The tolerance value is a freely selectable light intensity value, a percentage value of a light intensity, a value ascertained by means of a mathematical process, etc.

The control unit activates, for example when the elevator door is closed and the lighting unit switched on, the emergency light unit if at least one light intensity value of the second light intensity curve is smaller than at least one light intensity value of the first light intensity curve. For that purpose the control unit compares the first light intensity curve with the second light intensity curve or the light intensity values of the two light intensity curves.

The first, but also the second, light intensity curve can be stored in a memory unit by the control unit. The first light intensity curve and the second light intensity curve can, for example, be ascertained in a learning process and stored in the memory unit. In that case the memory unit can be a unit integrated in the control unit or a unit connected with the control unit by way of a communications network.

The light sensor unit can be integrated in an elevator operating unit which is arranged in an elevator cage. In addition, the control unit and the emergency light unit can be integrated in the elevator operating unit.

However, the control unit can also represent a separate unit or can also be designed as a sub-function of the elevator control unit controlling the elevator installation. As control unit use can be made of any unit which can process the light intensity values, for example a processor, a computer, a commercially available computer or a server with commercially available components.

The emergency light unit can be screened from extraneous light by means of laterally arranged light barriers. In that case the laterally arranged light barriers ideally represent a housing open towards the elevator interior. By "open side" of the housing is meant that the side is permeable by light. For example, the open side of the housing could be covered by a transparent pane for protection of the light sensor unit. Designated as extraneous light is that light which can impair the measurement results in the determination of the first and second light intensity curves. That can be, for example, light which originates from the lighting unit of the elevator operating unit or light directly incident in the light sensor unit. The keeping away of extraneous light could alternatively or cumulatively also take place by the control unit, for example in that for the time of determination of the light intensity values all light sources in the elevator control unit or other units, for example a switch, display screen, lighting unit, etc., in the elevator cage or in the entire elevator installation are switched off.

In some embodiments, the emergency light is activated only when it is actually necessary. On the one hand, the method is performed only when the elevator door is closed and on the other hand only when, with the lighting unit activated, at least one light intensity value from the second light intensity curve is smaller than a light intensity value of the first light intensity curve. Thus, for example, it is not necessary for the emergency light unit to be activated in the rest mode (standby operation) of the elevator installation.

In at least some cases, a further advantage is to be seen in that the temporal course or dynamic course of the light intensity can be determined in simple mode and manner. Thus, for example, it could be established if illumination means, bulbs, LED lamps, fluorescent tubes, etc., fail and an exchange of this illumination means is necessary.

BRIEF DESCRIPTION OF THE DRAWINGS

The disclosed embodiments are explained in more detail using the figures, in which.

DETAILED DESCRIPTION

Figure 1:
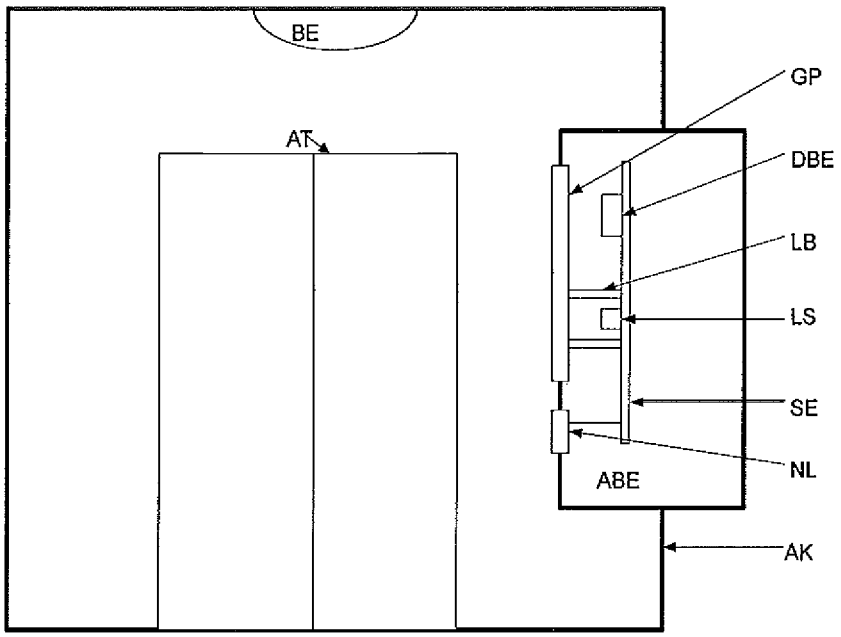
FIG. 1 shows a simplified illustration of an elevator cage with an elevator operating unit.

FIG. 1 shows a simplified illustration of an elevator cage AK with an elevator operating unit ABE. The interior of an elevator cage AK with an elevator door AT, a lighting unit BE and an elevator operating unit ABE is shown.

The elevator operating unit ABE is used, inter alia, for input of a destination story and for that purpose contains switches, buttons, touch-sensitive operating elements, etc., which are not shown. An elevator operating lighting unit DBE, which is not explained further, is used for illumination of the elevator operating unit or the switches, buttons, touch-sensitive operating elements, etc. A light sensor unit LS is arranged in the elevator operating unit ABE behind a transparent pane GP. Light barriers LB are arranged laterally adjacent to the light sensor unit LS for protection from extraneous light which could emanate from, for example, the elevator operating lighting unit DBE. These light barriers LB can form, together with a base plate (not illustrated), on which the light sensor unit LS is mounted, a housing which is permeable towards the elevator cage interior by light such as is shown in this example by means of the transparent pane GP. The housing can also consist of a part which can be shaped as desired. In that case that extraneous light which could impair determination of the light intensity values can be effectively kept away from the light sensor unit LS.

The elevator operating unit ABE further comprises a control unit SE and an emergency light unit NL. In that case the control unit SE is connected together with the light sensor unit LS and the emergency light unit NL by way of a suitable communications network, for example a wire-bound, a wire-free or a radio communications network, etc. In further embodiments, the control unit SE, light sensor unit LS and emergency light unit NL can be combined in one unit and, for example, can be arranged on a circuitboard.

Light intensity values, whether with activated or deactivated lighting unit BE, in the interior of the elevator cage AK are in this example ascertained by the light sensor unit LS when the elevator door AT is closed and are communicated to the control unit SE. The determination of these light intensity values could also be carried out with the elevator door open, wherein then the effects of light outside the elevator cage are relevant. The control unit SE generates, with the lighting unit BE deactivated, a first light intensity curve from the at least two first light intensity values, which are transmitted by the light sensor unit LS, less a tolerance value and stores this curve in, for example, a memory unit (not illustrated). Moreover, with the lighting unit BE activated the control unit SE generates or creates, in certain circumstances less a tolerance value, a second light intensity curve from the at least two second light intensity values transmitted by the light sensor unit LS. This curve can similarly be stored in a memory unit.

In order to activate the emergency light unit NL, the control unit SE compares the light intensity values of the light intensity curve with light intensity values of the second light intensity curve. If at least one light intensity value of the second light intensity curve is smaller than at least one light intensity value of the first light intensity curve the emergency light unit NIL is activated by the control unit SE when the elevator door AT is closed and the lighting unit BE is activated.

Figure 2:
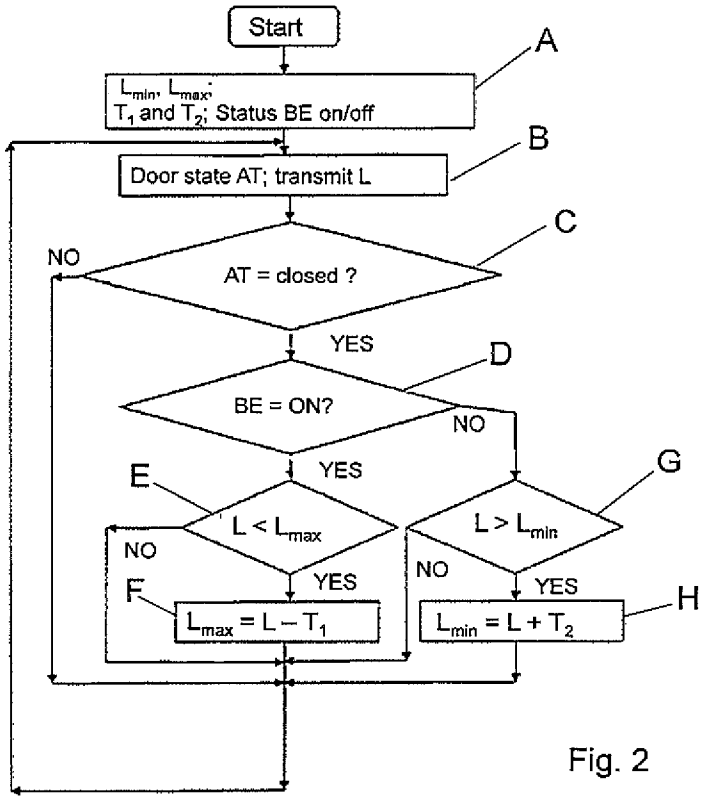
FIG. 2 shows a possible learning process for determination of the light intensity curves.

FIG. 2 shows a possible learning process for determination of light intensity curves $L_1$ and $L_2$. The determination of the light intensity curves $L_1$ and $L_2$ begins at the start. Thereafter, in step A the minimum (with deactivated lighting unit BE) and maximum (with activated lighting unit BE) light intensity values $L_{min}$ and $L_{max}$ are determined by the light sensor unit LS and transmitted to the control unit SE. Moreover, the tolerance values $T_1$ and $T_2$ are determined and stored in the control unit SE or in a memory unit connected with the control unit SE. Finally, the status of the lighting unit BE, i.e. activated or deactivated, is ascertained by the control unit SE. The tolerance values $T_1$ and $T_2$ can be constant or variable. In that case, $T_1$ can be equal to $T_2$.

In step B the closed state of the elevator door AT is determined by the control unit SE and the light sensor unit LS transmits to the control unit SE at least one determined light intensity value L with respect to the time t.

In step C it is checked by the control unit SE whether the ascertained closed state of the elevator door AT signifies that the elevator door is closed. If the elevator door AT is open, the method is interrupted at this point and begins again at step B. The control unit SE can then transmit to the elevator door AT or to the elevator control unit a request for closing the elevator door AT.

If the elevator door AT is closed, it is checked in step D whether the lighting unit BE is activated.

If not only the elevator door AT is closed, but also the lighting unit BE activated, it is checked in step E whether the at least one light intensity value L, which was ascertained in step B and transmitted to the control unit SE, with activated lighting unit BE represents the maximum measured light intensity value $L_{max}$ according to step A. If this is so, then according to step F the (second) light intensity value less a tolerance value $T_2$ is set as a new maximum light intensity value $L_{max}$ and used for generation of the second light intensity curve $L_2$. Otherwise, the method is interrupted at this point and begins again at step B.

If it results from the check according to step D that the light unit BE is deactivated, the method is continued by step G. For this purpose it is investigated whether the (first) light intensity value L, which was ascertained by the light sensor unit LS and transmitted to the control unit SE, with deactivated lighting BE is greater than the minimum light intensity value $L_{min}$ ascertained in step A. If this is so, then according to step H the (first) light intensity value plus a tolerance value $T_1$ is set as new minimum light intensity value $L_{min}$ and used for generation of the first light intensity curve $L_1$. Otherwise, the method is interrupted at this point and begins again at step B.

The generation of the light intensity curves $L_1$ and $L_2$ can be as desired. Thus, a mathematical method, for example an interpolation, can be used so that, for example, polynomial functions can be created from the light intensity values as light intensity curves $L_1$ and $L_s$. In addition, the light intensity curves $L_1$ and $L_2$ could merely form numbers or a series of values.

The method can be continued until all ascertained light intensity values L, whether with activated or deactivated lighting unit BE, were used within a freely selectable time period for generation of the two light intensity curves $L_1$ and $L_2$. In that case, the light intensity values L are ascertained by the light sensor unit LS at a spacing dt in time.

With the help of this learning process or method it is possible to determine the dynamic course or the course over time of the light intensity values not only when the lighting unit BE is activated, but also when it is deactivated. Fluctuations in the light intensity which, for example, are due to opening of the elevator door, partial covering of the light sensor LS, partial absorption of the light by the lighting unit BE by person or users in the elevator cage, etc., can be detected and are taken into consideration in the determination of the light intensity curves. It is thus possible for the emergency light unit NL to be activated only when this is actually needed.

Figure 3:
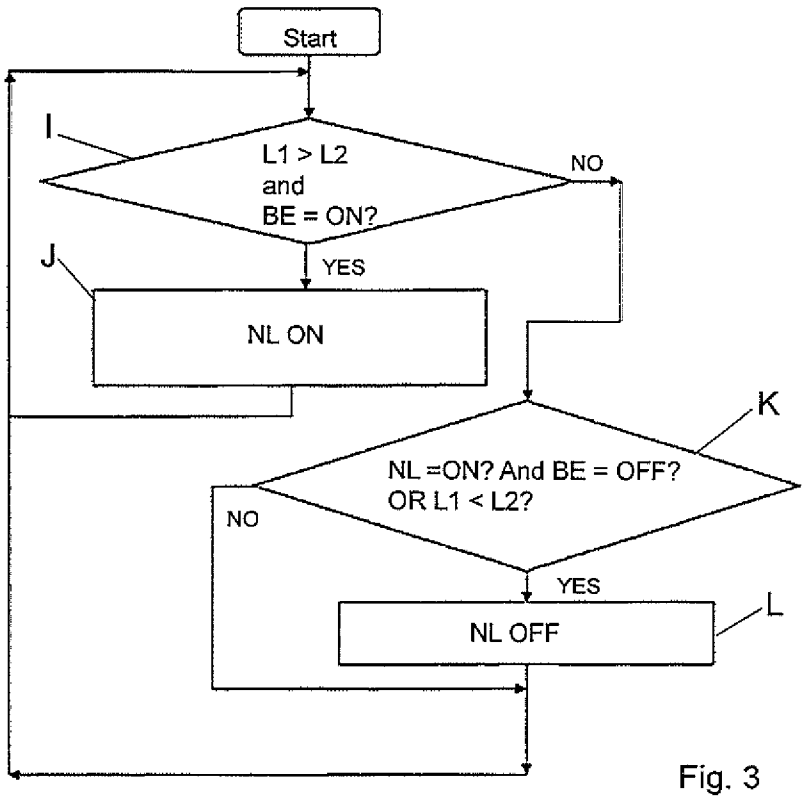
FIG. 3 shows a possible flow chart for activation of the emergency light unit.

FIG. 3 shows a possible flow chart for activation of the emergency light unit NL. The method again begins with the start.

In step I it is checked whether at least one (second) light intensity value L or $L_{max}$ of the second light intensity curve $L_2$, which is the curve of the light intensity values L when the lighting unit BE is activated, is smaller than at least one (first) light intensity value L, $L_{min}$ of the first light intensity curve $L_1$, which is the curve when the lighting unit BE is deactivated. The two light intensity curves $L_1$ and $L_2$ were generated in accordance with the preceding FIG. 2.

If the check according to step I gives a positive statement, if thus at least one light intensity value L or $L_{max}$ of the second light intensity curve $L_2$ is smaller than a light intensity value L or $L_{min}$ of the first light intensity curve $L_1$, the emergency light unit NL is activated by the control unit SE in step J.

If, however, the check in step I has the result that the light intensity values L or $L_{max}$, of the second light intensity curve $L_2$ are always greater than the light intensity values L or $L_{min}$ of the light intensity curve $L_1$, thus whether $L_2>L_1$, it is checked in step K whether the emergency light unit NL is already activated and the lighting unit BE deactivated. If this is so, i.e. the emergency light unit NL is activated and the lighting unit BE is deactivated, the emergency light unit NL is deactivated in step L and in certain circumstances the stored light intensity curves $L_1$ and/or $L_2$ are erased, and the method is, for example, reset and begins anew. If, on the other hand, this is not so, the method is interrupted in step K and begins again at step I.

Figure 4:
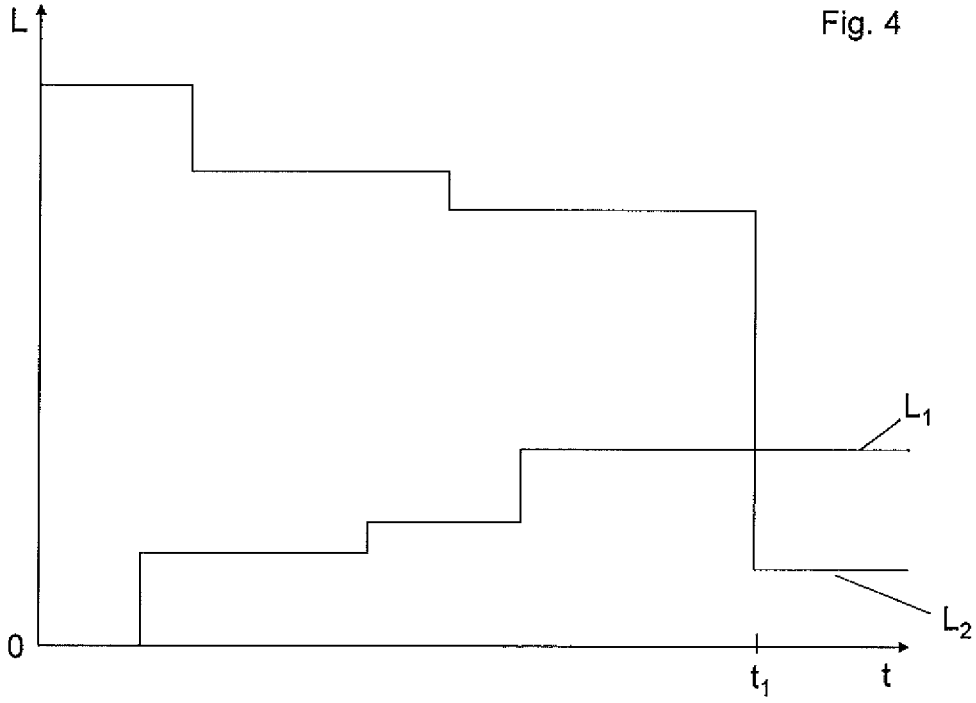
FIG. 4 shows an example of a diagram with a first and a second light intensity curve.

FIG. 4 shows an example of a diagram with a first light intensity curve $L_1$ and a second light intensity curve $L_2$, wherein the light intensity curves $L_1$ and $L_2$ are each a function L(t) of time t and were ascertained or generated in accordance with the preceding FIGS. 2 and 3.

When the elevator door AT is closed and the lighting unit BE deactivated at least two (first) light intensity values L or $L_{min}$ are determined within a time period by a light sensor unit LS and transmitted to a control unit SE. The control unit SE generates or sets up, plus a tolerance value $T_1$, a first light intensity curve $L_1$. The second light intensity curve $L_2$ is similarly set up or generated from at least two (second) light intensity values L or $L_{max}$ within the or another time period, but with activated lighting unit BE and less a tolerance value $T_2$.

If, as illustrated in this diagram, at least one light intensity value L or $L_{max}$ of the second light intensity curve $L_2$ is smaller than at least one light intensity value L or $L_{min}$ of the first light intensity curve $L_1$ at the time $t_1$ then the emergency light NL is activated.

Figure 5:
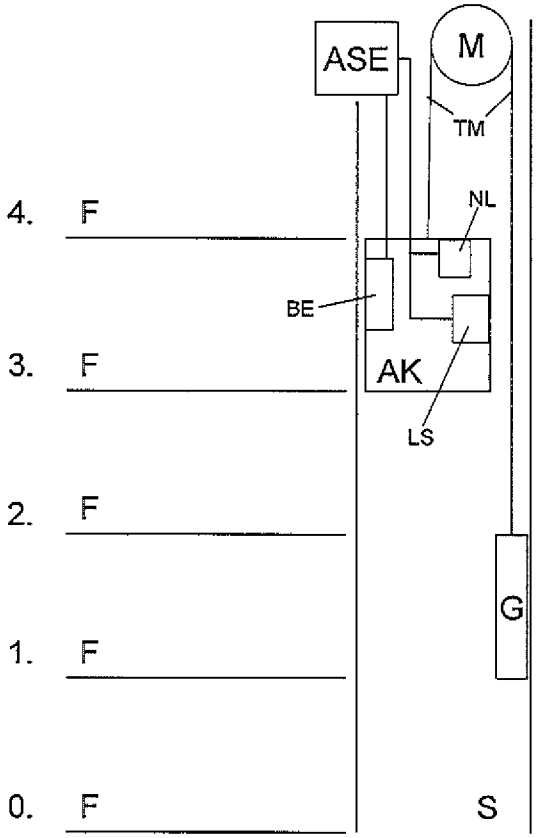
FIG. 5 shows a simplified illustration of an elevator installation.

FIG. 5 shows a simplified illustration of an elevator installation. An elevator cage AK moves vertically in a shaft S and in that case travels to the stories 0. F to 4. F. The elevator installation can, according to the respective elevator type, here, for example, a drive pulley elevator, have a counterweight G which is connected with the elevator cage AK by way of support means TM. The elevator type can, in various embodiments, be of any kind. Thus, a hydraulic elevator or another elevator type could also be used. The elevator cage AK is moved by means of a drive M, in this example a drive pulley drive. In addition, the elevator installation comprises an elevator control unit ASE which can also be used for the method in accordance with FIGS. 1 to 4. A lighting unit BE, an emergency light unit NL and a light sensor unit LS are arranged in the elevator cage AK, which are connected by way of a suitable communications network, be it a wire-bound or a radio-operated communications network, with the elevator control unit ASE. For reasons of clarity the elevator operating unit ABE according to FIG. 2 is not illustrated.

The method according to FIGS. 1 to 4 is used in the elevator installation for activation of the emergency light unit NL.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. We therefore claim as our invention all that comes within the scope and spirit of these claims.

We claim:

1. A method for activating an elevator emergency light in an elevator cage, the method comprising:

using a light sensor to generate light intensity values in an interior of the elevator cage while a door of the elevator cage is closed, the light sensor being arranged in the elevator cage;

generating from the light sensor a first light intensity value while a lighting unit in the elevator cage is deactivated and generating, using a control unit, a first light intensity curve from the first light intensity value and at least another light intensity value generated while the lighting unit in the elevator cage is deactivated;

generating from the light sensor a second light intensity value while the lighting unit in the elevator cage is activated and generating, using the control unit, a second light intensity curve from the second light intensity value and at least another light intensity value generated while the lighting unit in the elevator cage is activated; and activating, using the control unit, an emergency light unit arranged in the elevator cage based on the control unit determining that at least one of the light intensity values of the second light intensity curve is smaller than at least one of the light intensity values of the first light intensity curve.

2. The method according to claim 1 wherein the control unit includes a processor for generating the first and second light intensity curves.

3. The method according to claim 1 wherein the control unit includes a computer for generating the first and second light intensity curves.

4. The method according to claim 1 wherein the first light intensity curve and the second light intensity curve are stored in the control unit.

5. The method according to claim 1 including generating the first light intensity curve by adding a tolerance value to each of the light intensity values generated by the light sensor while the lighting unit is deactivated.

6. The method according to claim 1 including generating the second light intensity curve by subtracting a tolerance value from each of the light intensity values generated by the light sensor while the lighting unit is activated.

7. An elevator operating unit comprising:

a light sensor in an interior of an elevator cage, the elevator cage comprising a door, the light sensor generating light intensity values in the elevator cage interior while the door was closed; and a processor-based control unit being programmed to receive a first light intensity value from the light sensor while a lighting unit in the elevator cage is deactivated and a second light intensity value from the light sensor while the lighting unit in the elevator cage is activated, and the control unit being programmed to activate an emergency light unit in the elevator cage based on the second light intensity value being smaller than the first light intensity value;

wherein the control unit generates a first light intensity curve from the first light intensity value and at least a further light intensity value generated while the lighting unit in the elevator cage is deactivated, generates a second light intensity curve from the second light intensity value and at least a further light intensity value generated while the lighting unit in the elevator cage is activated, and activates the emergency light unit based on the control unit determining that at least one of the light intensity values of the second light intensity curve is smaller than at least one of the light intensity values of the first light intensity curve.

8. The elevator operating unit according to claim 7 including a light barrier at least partially screening the light sensor from extraneous light.

9. The elevator operating unit according to claim 8 wherein the light barrier includes a housing that is at least partially open toward the interior of the elevator cage.

10. An elevator installation, comprising:

an elevator cage disposed in a shaft, the elevator cage including a door;

a processor-based control unit;

a light sensor disposed in an interior of the elevator cage;

a lighting unit disposed in the interior of the elevator cage; and an emergency light unit disposed in the interior of the elevator cage, the control unit being configured to receive light intensity values from the light sensor, the light intensity values having been generated by the light sensor while the door was closed, and the control unit being configured to activate the emergency light based on a one of the received light intensity values generated while the lighting unit is activated being smaller than another of the received light intensity values generated while the lighting unit is deactivated;

wherein the control unit generates a first light intensity curve from the first light intensity value and at least another light intensity value generated while the lighting unit in the elevator cage is deactivated, generates a second light intensity curve from the second light intensity value and at least another light intensity value generated while the lighting unit in the elevator cage is activated, and activates the emergency light unit based on the control unit determining that at least one of the light intensity values of the second light intensity curve is smaller than at least one of the light intensity values of the first light intensity curve.

11. One or more computer-readable storage media having encoded thereon instructions that, when executed by a processor, cause the processor to perform a method, the method comprising:

receiving light intensity values from a light sensor disposed in an interior of an elevator cage, the light intensity values having been generated by the light sensor while a door of the elevator cage was closed, a first of the light intensity values being generated while a lighting unit in the elevator cage is deactivated and a second of the light intensity values being generated while the lighting unit is activated; and activating an emergency light unit in the elevator cage based the second light intensity value being smaller than the first light intensity value;

wherein the method includes generating a first light intensity curve from at least two of the light intensity values generated while the lighting unit in the elevator cage is deactivated including the first light intensity value, generating a second light intensity curve from at least two of the light intensity values generated while the lighting unit in the elevator cage is activated including the second light intensity value, and activating the emergency light unit based on determining that at least one of the light intensity values of the second light intensity curve is smaller than at least one of the light intensity values of the first light intensity curve.

* * * * *